United States Patent [19]

Schroeder et al.

[11] Patent Number: 4,944,056

[45] Date of Patent: Jul. 31, 1990

[54] METHOD AND APPARATUS FOR TRANSPORTING A DISABLED PERSON

[75] Inventors: Roger A. Schroeder, Tonawanda, N.Y.; Robert H. Broyden, Bristol, Va.; Robert C. Dearstyne, Amherst, N.Y.; Joseph L. Magner, Piney Flats, Tenn.; Randall J. Gephart; David W. Dayton, both of Abingdon, Va.; Raymond A. Newman, Cheektowaga, N.Y.

[73] Assignee: The Research Foundation of State University of NY, Albany, N.Y.

[21] Appl. No.: 250,335

[22] Filed: Sep. 28, 1988

[51] Int. Cl.[5] ..... A61G 7/10

[52] U.S. Cl. ..... 5/81 R; 5/83; 5/87

[58] Field of Search ..... 5/81 R, 83–87; 4/560–562, 205, 208; 212/216, 218, 220

[56] References Cited

U.S. PATENT DOCUMENTS

| | | | |
|---|---|---|---|
| 2,598,570 | 5/1952 | Lewis | 212/220 |
| 3,123,224 | 3/1964 | Kral | 5/81 R |
| 3,530,851 | 9/1970 | Geschickter | 5/83 X |
| 4,005,479 | 1/1977 | Reyer | 5/85 X |
| 4,202,064 | 5/1980 | Joergensen | 5/83 |

*Primary Examiner*—Michael F. Trettel

*Attorney, Agent, or Firm*—Robert P. Simpson; Michael L. Dunn

[57] ABSTRACT

Methods and apparatus are provided for transporting a disabled person in a carrying means. One embodiment of the apparatus includes a dual-track structure for supporting a hoist and trolley which are controlled by the disabled person. In a further embodiment, the structure is designed to be supported by a floor and ceiling together, or by a floor alone, and is adjustable to accommodate rooms of different dimensions. A still further embodiment of the invention includes mechanical and electronic safety means for the hoist which senses a malfunction and provides an appropriate response thereto, such as sounding an alarm and/or lowering the hoist at a specific pre-programmed location and at a controlled descent rate. The embodiments may be used independently or in concert in accordance with the invention. One method of the invention comprises transporting the disabled person utilizing the dual-track structure controlled by the disabled person. Another method comprises utilizing the structure supported by a floor and ceiling togther, and still another method comprises providing safety for the disabled person being transported by sensing a malfunction and providing an appropriate response to the malfunction. The methods may be used independently or together.

23 Claims, 10 Drawing Sheets

METHOD AND APPARATUS FOR TRANSPORTING A DISABLED PERSON

BACKGROUND OF THE INVENTION

The present invention relates to transfer hoist systems for use by a disabled person, providing him with independent mobility. The invention also provides an assistive device for transporting disabled persons for use in hospitals, clinics, nursing homes, etc.

Transfer hoists for disabled persons are typically used by paraplegic, quadriplegic, handicapped, weak, or elderly persons to transport themselves from one place to another, such as from a wheelchair to a bed, without assistance from others. Unfortunately, most prior art transfer hoist systems tend to be modeled after industrial hoist systems and, consequently, are not satisfactory for use in domestic settings. For example, a typical safety mechanism found in industrial hoists causes the hoist to hold or freeze upon sensing a malfunction, leaving the load literally hanging in air.

Prior art hoists are commonly mounted on and suspended from overhead rails which are secured to ceiling joists. For example, Twitchell et al., U.S. Pat. No. 4,243,147, Jan. 6, 1981, discloses a three-dimensional lift system wherein rails are permanently secured to the ceiling. There are several disadvantages associated with ceiling-mounted systems. Since the joists must support the weight of the hoist support, the hoist, and the person being lifted, the joists themselves must be extremely strong. Reinforcement of existing ceiling joists is sometimes required. Ceiling-supported systems are also permanent. If a disabled person moves to a new residence, travels to visit friends or relatives, or even desires to stay at a hotel, he cannot simply pack up the hoist system and take it with him. Even within his own residence, if the user wishes to change bedrooms, for example, he cannot easily move the ceiling-supported transport system to his new room.

Another common problem associated with prior art hoists is that the hoists are frequently supported by a single I-beam. The trolley wheels cf the hoist usually engage and track on the upper surfaces of the lower flange portion of the I-beam, (see, e.g., McCord, U.S. Pat. No. 4,372,452, Feb. 8, 1983). Unfortunately, I-beam supported hoists are somewhat unstable in that they permit swinging of the disabled person. This "pendulum" effect of I-beam or single rail supported systems can be disconcerting and even dangerous to handicapped individuals.

Floor mounted hoist systems also have disadvantages. To ensure stability., floor mounted systems necessarily require that a large surface area be reserved for placement of the legs of the support structure. For example, Simmons et al., U.S. Pat. No. 4,296,509, Oct. 27, 1981, discloses a dual-tripod supported invalid lift. The tripod renders a rather large triangular area of floor space unusable for any other purpose, and the structure itself is inhibitive of someone attempting to assist the invalid, i.e., it simply "gets in the way". Floor mounted structures also pose serious headroom problems as well. Since the hoist support rails are necessarily lower than the ceiling, the disabled person often has little room between his head and the support rails. In some designs where the harness swivels or swings, as in single rail supported systems, the invalid is in danger of bumping his head.

One device which has apparently solved the instability problem of swinging or swiveling harnesses is an invention disclosed by Hachey et al., U.S. Pat. No. 4,627,119, Dec. 9, 1986. Unfortunately, this floor mounted support structure appears to require a specific harness and is not easily adaptable to other harnesses. Moreover, since the harness is not rotatable, the orientation of the person is fixed as he is transported between the wheelchair and the bed. This is disadvantageous since it is sometimes desirable to change the orientation of a person after leaving the wheelchair but before entering the bed. Another drawback of this device is that the support structure is wider than the person, again utilizing a relatively large floor space as is common in floor-mounted systems.

Perhaps the most important failure of prior art systems is their safety mechanisms. Disabled persons are especially vulnerable to a variety of potentially harmful conditions and events. Systems to aid handicapped persons must necessarily provide safety means to compensate for the user's disabilities. Unfortunately, many prior art devices do not adequately protect the handicapped individual. This shortcoming is probably attributable to the fact that many designs for hoist systems for the disabled are borrowed from industrial applications.

In particular, there are two potential malfunctions or problems which are typically associated with hoist systems for disabled persons. The first potential problem is that of a system power failure occurring during the hoist operation. The safety mechanism of the Twitchell et al. invention, discussed above, is typical of prior art solutions, in that the motor and transmission of the hoist become locked upon loss of power. Thus, in the event of a power failure, the disabled person is literally "left hanging" in a somewhat vulnerable position. Other prior art devices provide for a manual override of the hoist in the event of power loss. Unfortunately, manual override schemes typically utilize a hand crank for manually lowering the disabled person. This crank is usually not within easy reach of the suspended person, and, in any event, usually requires a second person to operate.

A second potential problem occurs when a disabled person encounters difficulty during the hoisting process. Many difficulties are readily imaginable. For example, the person may drop the control unit for the hoist and be unable to retrieve it; the user may faint or become otherwise incapacitated; the system itself may develop a malfunction short of complete power failure. Prior art devices have not provided a satisfactory solution to this problem.

Thus, it is seen that there has existed a long-felt need for a better hoist system for disabled persons.

SUMMARY OF THE INVENTION

The invention provides a method and apparatus for transporting a disabled person in a carrying means. In particular, the invention includes a pair of vertically adjustable end support members; a pair of transverse support members extending between the vertical end support members; hoist means operatively arranged to raise or lower the carrying means; trolley means arranged to move the hoist means back and forth along the transverse support members: first motor means operatively arranged to power the hoist means; second motor means operatively arranged to power the trolley means, and control means operatively arranged to control the first and second motor means. The invention also includes safety means for a hoist for disabled persons which senses a malfunction and provides a controlled-rate of descent of the carrying means of the hoist in response to the malfunction. The invention further provides a support structure for a hoist for a disabled person which includes a pair of vertical adjustable end support members; a pair of transverse support members extending between and fixedly secured to the upper ends of the vertical end support members; wherein the transverse support members are operatively arranged to support a hoist for disabled persons.

The invention also provides a method for transporting a disabled person by raising and lowering a movable hoist in response to control signals provided by the person. The hoist is supported by both a ceiling and a floor and includes safety for the disabled user of the hoist, by sensing malfunctions and providing appropriate responses thereto. Malfunctions sensed by the method and apparatus of the invention include system power failure as well as user failure, where the user is defined to be the disabled person using the hoist. The appropriate responses to the malfunction include sounding an audible or visual alarm (annunciator) or providing a controlled rate of descent of the hoist. Responses may also include a programmed return to a "home" or starting position, followed by a controlled descent. The invention also provides a method for supporting a hoist and trolley for a disabled person which includes supporting the hoist and trolley by means of a dual track in contact with a ceiling, where each track has a web which supports one or more of the trolley wheels and the distance from the ceiling to the bottom of the body of the supported hoist and trolley is independent of the thickness of the web. Finally, the invention provides a method for transporting a disabled person, including the steps of: placing the person in a carrying means; raising and lowering the carrying means in response to control signals from the person; and sensing when the raising and/or lowering is proceeding improperly and providing an appropriate response thereto.

Accordingly, an overall object of the invention is to provide a novel method and apparatus for transporting a disabled person.

A more particular object of the invention is to provide a hoist for a disabled person having safety means which senses a malfunction and provides a controlled rate of descent of the carrying means of the hoist or other appropriate response to the malfunction.

Still another object of the invention is to provide a support structure for a hoist for a disabled person which may be supported by both a floor and a ceiling.

A further object of the invention is to provide a support structure for a hoist for a disabled person which is adjustable to accommodate ceilings of different heights.

Still a further object of the invention is to provide a hoist system for a disabled person which is portable and may be easily moved from one location to another.

Yet another object of the invention is to provide a hoist system for a disabled person which affords substantial headroom between the disabled person's head and the hoist.

These and other objects and advantages will become apparent from the specification, the drawings, and the appended claims.

DETAILED DESCRIPTION OF THE INVENTION

Figure 1:
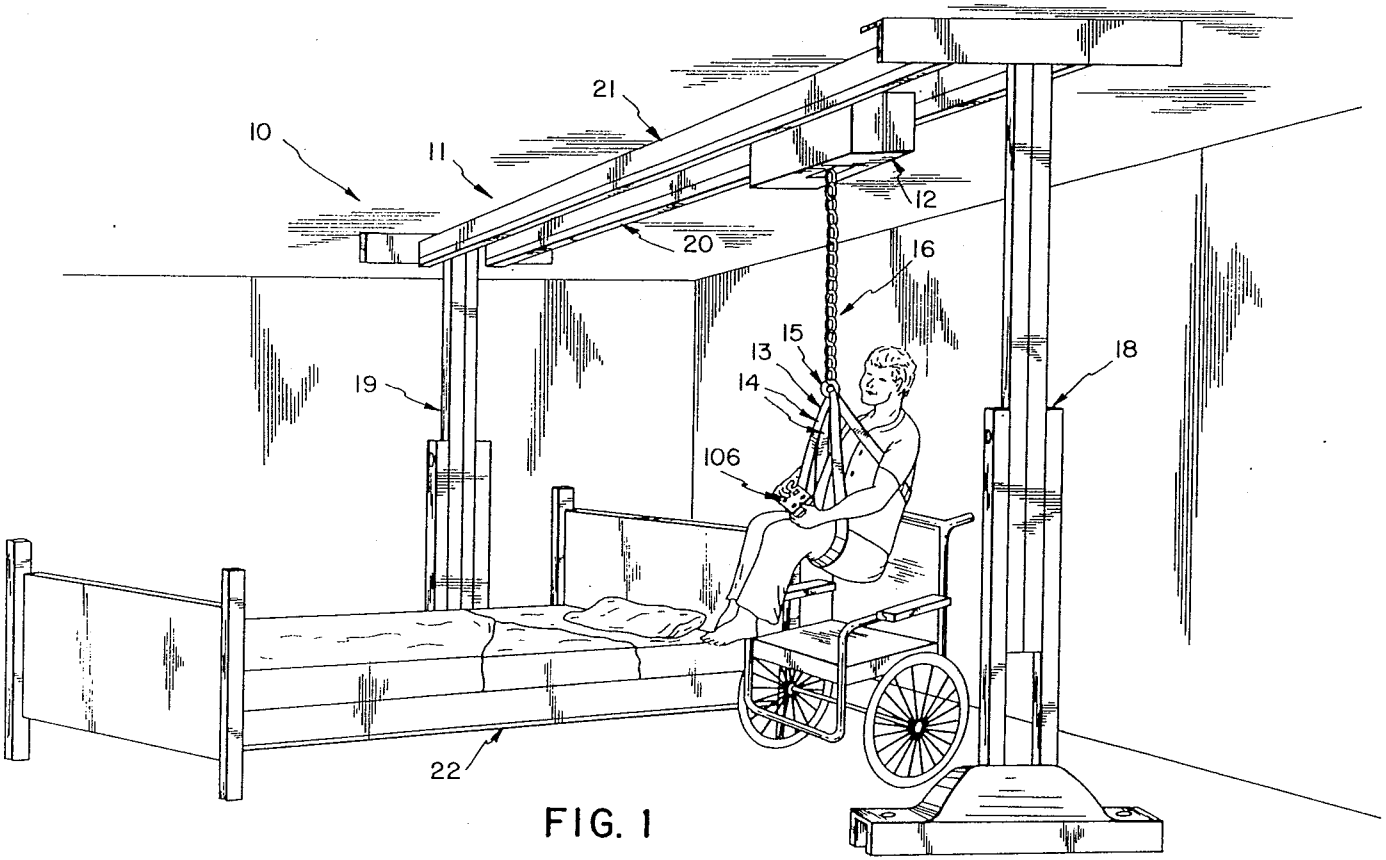
FIG. 1 broadly illustrates the transfer hoist system of the invention.

At the outset, it should be clearly understood that like reference numerals are intended to identify the same structural elements, portions or surfaces consistently throughout the several drawing figures, as such elements, portions or surfaces may be further described or explained by the entire written specification. Unless otherwise indicated, the drawings are intended to be read, (e.g., cross-hatching, arrangement of parts, etc.), together with the specification, and are to be considered a portion of the entire "written description" of this invention. As used in the following description, the terms "horizontal", "vertical", "left", "right", "up", "down", "inward" and "outward", as well as adjectival and adverbial derivatives thereof, (e.g., "horizontally", "rightwardly", "upwardly", etc.), refer to the relative orientations of the illustrated structure. The terms "forward" and "reverse" are synonymous with "leftwardly" and "rightwardly".

The invention broadly provides a transfer hoist system for use by a disabled person. The apparatus of the invention includes a pair of vertically adjustable end support members, a pair of transverse support members extending between the upper ends of the end support members, hoist means to raise or lower a carrying means which holds the disabled person, trolley means which move the hoist means back and forth along the transverse support members, first motor means to power the hoist means, second motor means to power the trolley means, and control means to power the first and second motor means.

The invention also includes safety means which monitors and senses system and user malfunctions and provides an appropriate response. A system malfunction is defined as any malfunction outside of the control of the person being transported, such as a power failure, a mechanical failure, etc. A user failure is defined as any failure or problem associated with the person being transported. For example, fainting or any other affliction which causes a person to be unable to control the hoist, or unable to complete a hoist operation are classified as user malfunctions. The safety means of the invention may be adapted to operate with existing hoist systems. In a broad sense, then, the invention includes support means, hoist means secured to the support means for raising and lowering carrying means which carry a disabled person, and safety means to sense a malfunction and to provide an appropriate response to the malfunction. The appropriate response may be merely sounding an alarm or causing an L.E.D. to light, or it may involve providing a controlled rate of descent for the hoist or other appropriate hoist or trolley movement.

The support means of the invention is uniquely designed to accommodate being supported by both a floor and a ceiling, and is adjustable to accommodate ceilings of different heights. Since the support means can be used with any hoist, the invention also broadly includes apparatus for supporting a hoist for disabled persons, including a pair of vertically adjustable end support members and a pair of transverse support members extending between and fixedly secured proximate the upper ends of the vertical support members.

What follows is a detailed description of a preferred embodiment of the invention, as illustrated by the drawings. It is intended that this description be interpreted as illustrative of the invention, and not in a limiting sense.

Referring to FIG. 1, which illustrates a preferred embodiment of the invention, transfer hoist system 10 generally includes support means 11 and hoist and trolley means 12. Support means 11 is shown as including vertical adjustable support members 18 and 19, and transverse support members 20 and 21 extending between vertical support members 18 and 19. Hoist and trolley means 12 includes a hoist for raising and/or lowering a disabled person suspended in carrying mean 13 by suspending means 16 which may be any suitable suspending means such as a chain, rope or strap, and also includes a trolley for moving the hoist back and forth along transverse support members 20 and 21. Although carrying means 13 is shown as including a set of straps 14 coupled to ring 15 and secured to suspending means 16, the invention is designed to accommodate a variety of carrying means, and is not restricted to the exact carrying means shown in FIG. 1.

FIG. 1 illustrates several features of the present invention. For example, vertical adjustable support members 18 and 19 are shown as being supported both by a floor and a ceiling. This dual-support design minimizes the floor area which must be dedicated for the support structure and obviates the need for reinforced ceiling joists. Also, since support members 18 and 19 are adjustable, the structure can accommodate rooms having different ceiling heights. Support means 11 may be constructed of any material or materials having sufficient compressive and tensile strengths, e.g., steel or structured plastics. In a preferred embodiment, support means 11 is constructed of lightweight aluminum. The adjustability of vertical support members 18 and 19, in conjunction with the lightweight construction, render support means or structure 11 portable, in that it may be easily moved from one room to another within a dwelling, or from dwelling to dwelling.

Another feature shown in FIG. 1 is the ample headroom between the user's head and hoist and trolley means 12. Since hoist and trolley means 12 is supported by transverse members 20 and 21 which are located proximate the ceiling, the user enjoys substantial headroom between his head and the hoist and trolley means. It is important to provide sufficient headroom to avoid injury to the user. For example, without sufficient headroom the user could sustain injury caused by rotation of suspending means 16, thereby causing him to bump his head. Ample headroom also permits use of the system with furniture of varying heights. For example, in FIG. 1, bed 22 is shown as a standard bed with a mattress and box-spring, whereas a specially-designed "low to the floor" bed would be required if the present invention did not provide substantial headroom.

Figure 2:
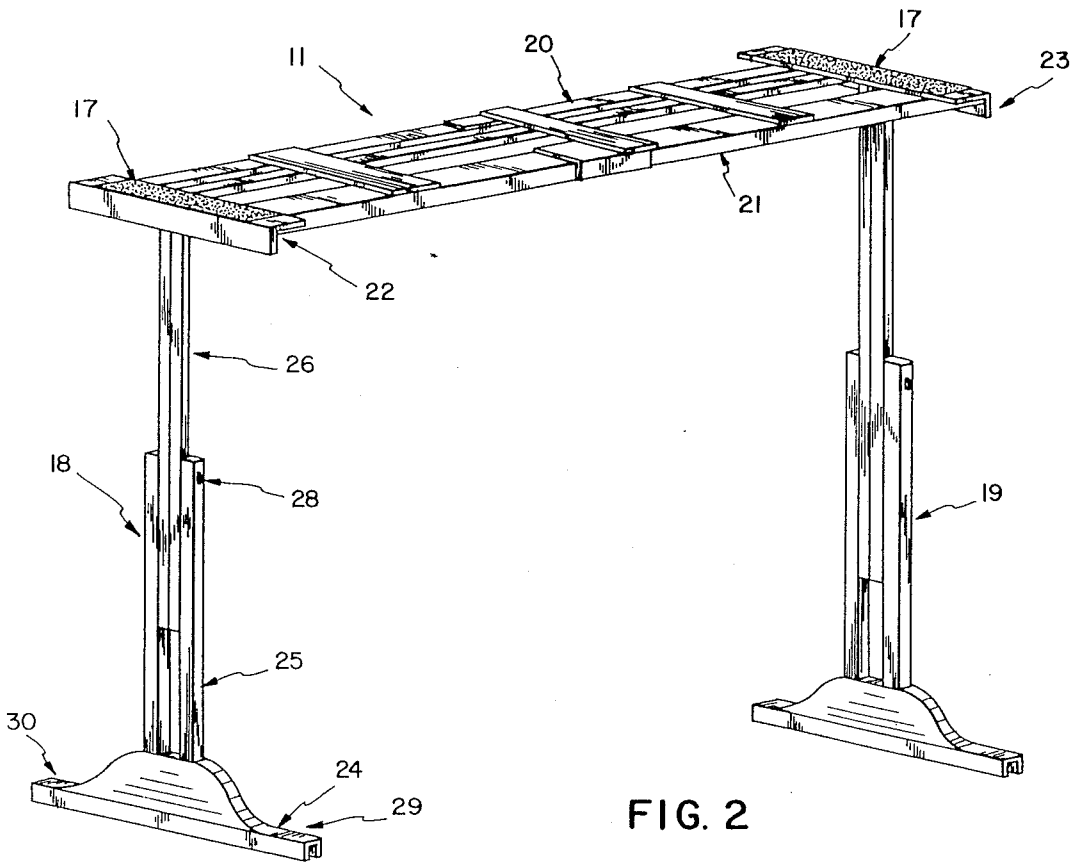
FIG. 2 is a perspective view of the support structure of the invention.

FIG. 2 is a perspective view of a preferred embodiment of the support structure of the invention. Other embodiments may be envisioned by those skilled in the art within the spirit of the invention disclosed herein. As shown in FIG. 2, support means 11 includes first adjustable vertical support member 18, second adjustable vertical support member 19, first transverse support member 20, and second transverse support member 21. Although transverse support members 20 and 21 are shown as fixed in length, these members may also be adjustable in length to accommodate rooms of different sizes. End connector 22 joins vertical member 18 with transverse members 20 and 21, while end connector 23 joins vertical member 19 with transverse members 20 and 21.

Since members 18 and 19 are identical, only member 18 will be described here, but it is to be understood that this description also applies to member 19. Adjustable vertical support member 18 includes footpad 24, lower vertical member 25, and upper vertical member 26. Members 25 and 26 are in telescoping engagement with each other, and may be adjusted to accommodate ceilings of varying heights. Once members 25 and 26 have been adjusted so as to place end connectors 22 and 23 in contact with a ceiling, locking mechanism 28 is adjusted to lock members 25 and 26 together. Locking mechanism 28 may be any means for locking. For example, members 25 and 26 may include a series of aligned through-bores through which a bolt is passed to lock the members together at a particular height. After locking mechanism 28 is engaged, footpad leveling means 29 and 30 are adjusted to raise support member 18 so as to compress rectangular foam pad 17 against the ceiling. Levelers 29 and 30 may be any well-known means for providing height adjustment to an apparatus, and may include spring-loaded casters for moving the structure. Foam pad 17 is a compliant material secured to end connectors 22 and 23 and has a substantial surface area to distribute the force exerted upon the ceiling. A coarse adjustment of the height of support structure 11 is achieved by locking mechanism 28, whereas a fine adjustment of the height is achieved by footpad leveling means 29 and 30. Thus, it is shown that support structure 18 is supported both by the floor upon which it rests and, also, by compressive forces applied by the structure upon the ceiling. Alternatively, support structure 18 may be used in a free-standing mode, supported only by the floor.

Figure 3A:
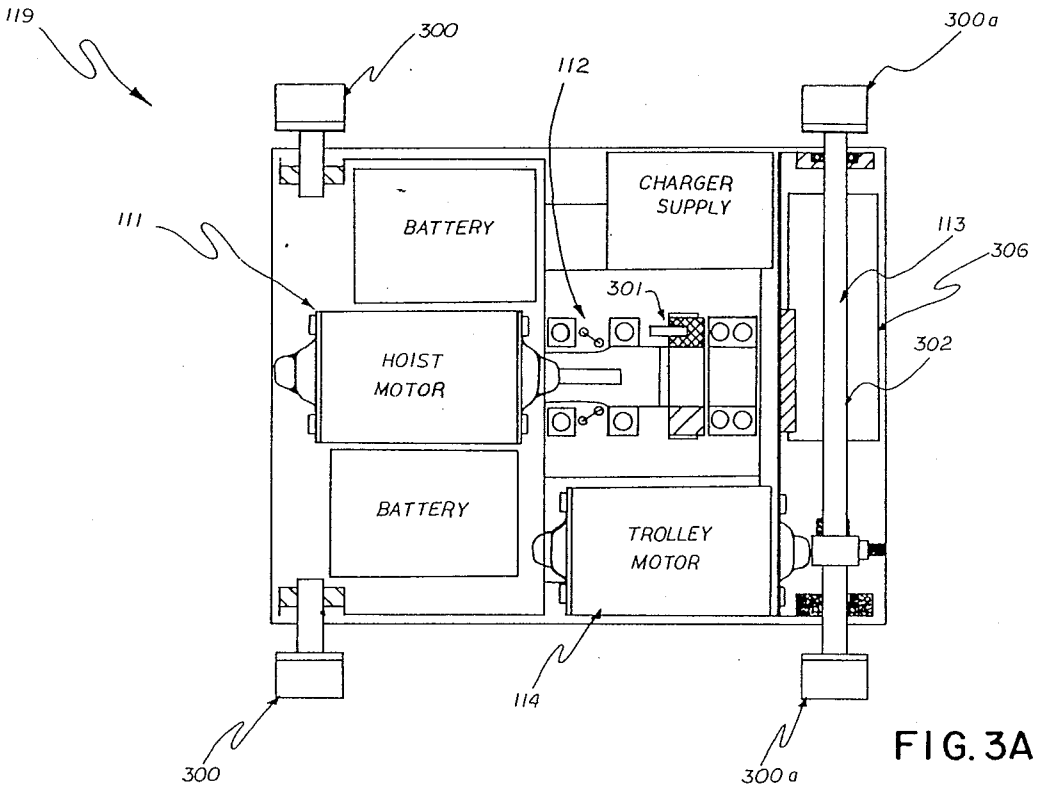
FIG. 3A is a sectional top view of the hoist means of the invention.
Figure 3B:
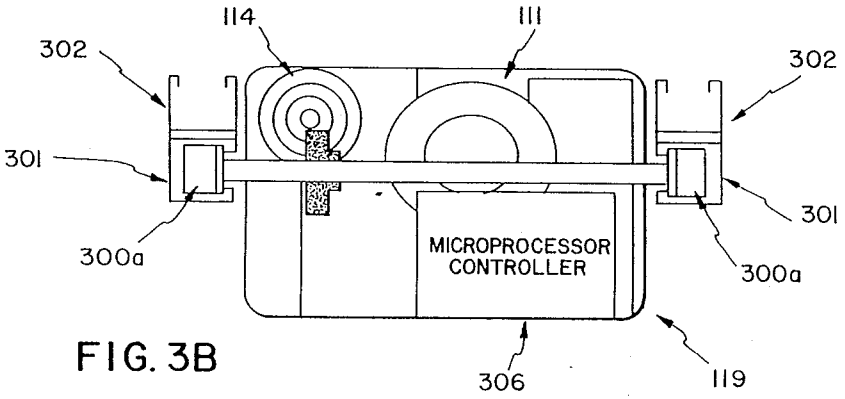
FIG. 3B is a sectional end view of the hoist means of the invention.

FIG. 3A is a top sectional view of a preferred embodiment of hoist means 119. Hoist means 119 rides along support members 20 and 21 on wheels 300 and **300*a*. Hoist means 119 is propelled along transverse support members 20 and 21 by trolley motor 114 which drives wheels 300*a* through axle 302. FIG. 3A shows the physical layout within hoist means 119 of hoist motor 111, hoist 112, gearset 301, trolley motor 114, the system batteries and charger supply, and microprocessor controller 306 which includes all of the electronic circuit aspects of the invention. FIG. 3B is a sectional end view of hoist means 119 which illustrates the unique manner in which wheels 300 and 300*a* engage lower channels 301 of transverse support members 20 and 21**.

Figure 3D:
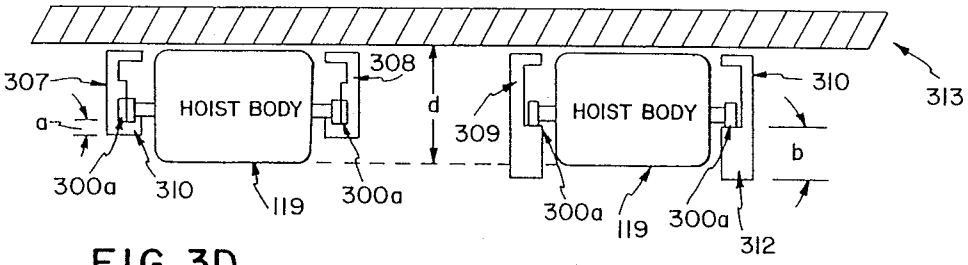
FIG. 3D is a sectional end view of the hoist illustrating the fact that the amount of headroom is independent of the web thickness of the dual-track supports.
Figure 3C:
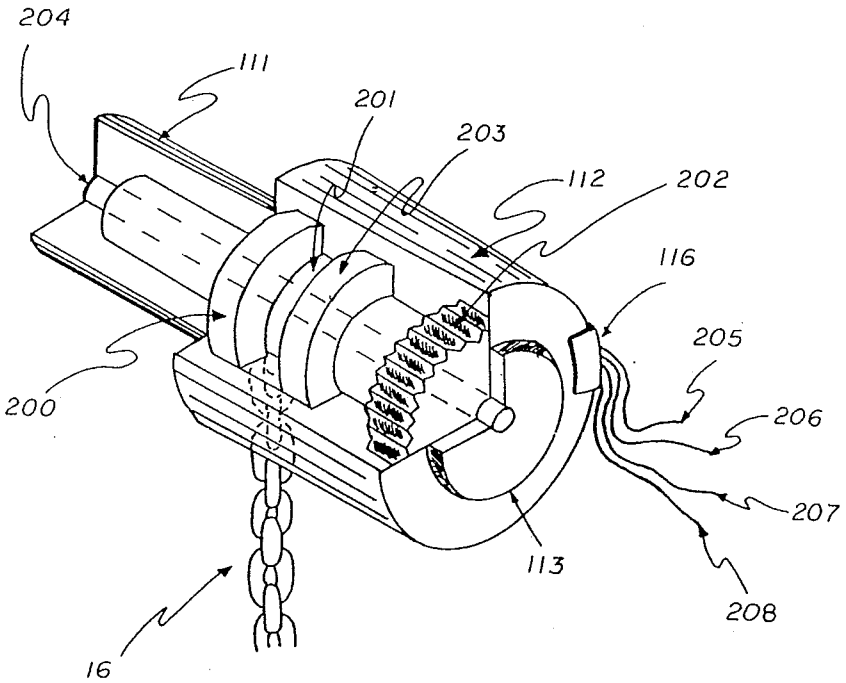
FIG. 3C is a fragmentary sectional view of the hoist of the invention.

FIG. 3C is a fragmentary sectional view of hoist 112 which raises and lowers carrying means 13 via suspending means 16. Hoist 112 is coupled to hoist motor 111 via common shaft 204. Hoist 112 includes bearings 200 and 203, oblique lay liftwheel 201, planocentric gear reduction 202, magnetic wheel 113, and Hall effect sensor 116. Hall sensor 116 communicates position and motion signals to a microcomputer via lines 205–208.

FIG. 3D illustrates two alternative embodiments of the hoist suspended from a ceiling 313. As shown on the left-hand side of FIG. 3D, hoist body 119 is supported by supports 307 and 308, each of which have a bottom web 311 of thickness "a". Shown on the right-hand side of FIG. 3D is hoist body 119 supported by supports 309 and 310, each of which have a bottom web 312 of thickness "b". Supports 309 and 310 are designed for a longer support span than supports 307 and 308, and for this reason dimension "b" is larger than dimension "a". FIG. 3D illustrates a unique feature of the dual-track support design of the present invention, i.e., that the distance "d" between ceiling 313 and the bottom of hoist body 119 is independent of the web thickness of the dual-track supports. This is an advantage over I-beam supports of the prior art, and functions to ensure maximum headroom for the user of the hoist.

Figure 4:
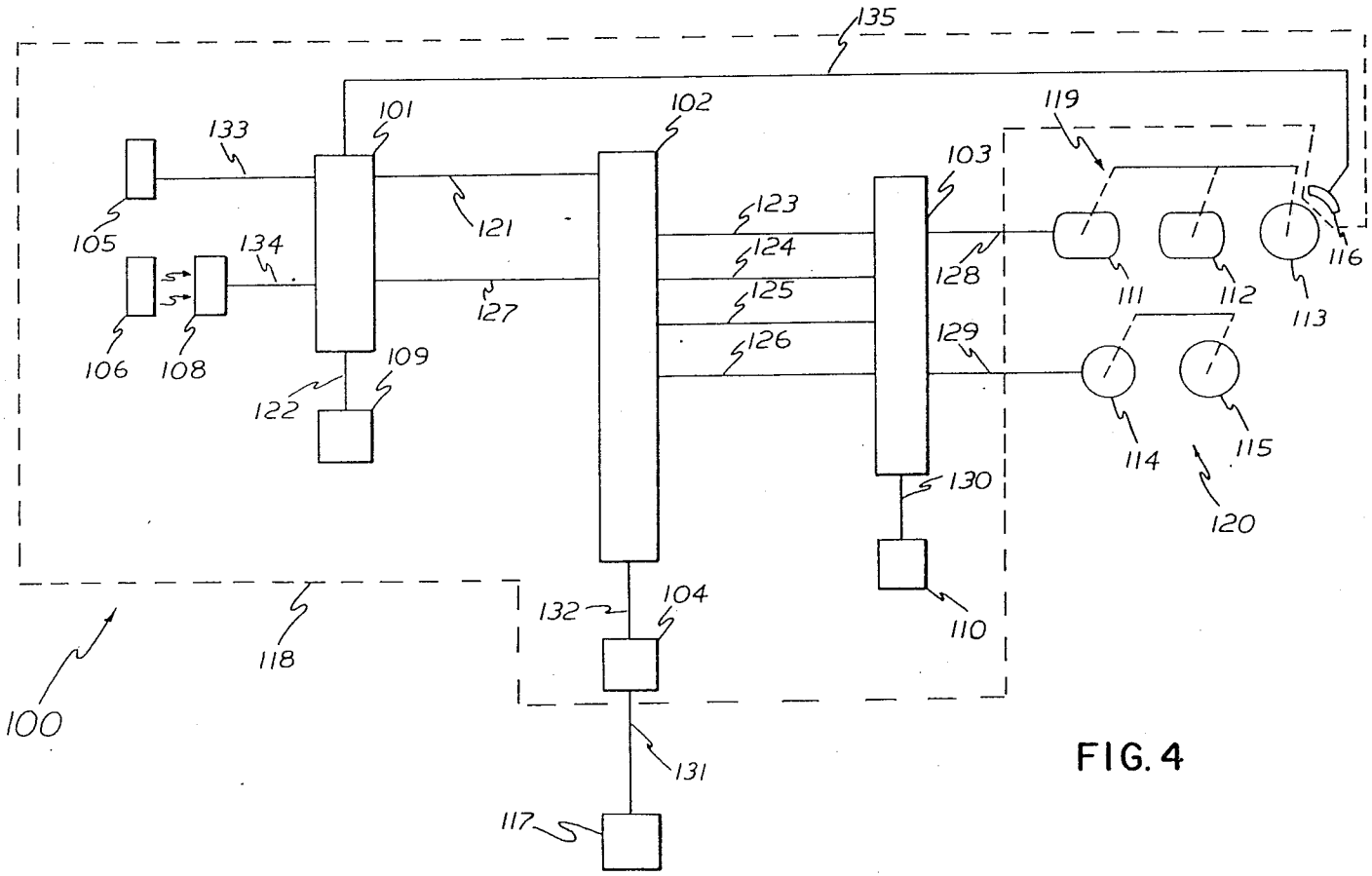
FIG. 4 is an electrical block diagram of the control and safety means of the invention.

FIG. 4 is an electrical block diagram of a preferred embodiment of the control and safety means of the invention. It is to be understood that many mechanical, electromechanical and electronic control and safety means may be envisioned by those skilled in the art in accordance with the present invention. Control and safety means 100 of the preferred embodiment shown in FIG. 4 includes four main components: control processing unit (CPU) 101, power circuit control logic (PCCL) 102, power circuit motor control (PCMC) 103, and charging circuit 104. Also shown in FIG. 4 are wired control unit 105, infra-red control unit 106, infra-red receiver 108, annunciator 109, battery 110, hoist means 119, trolley means 120, sensor 116, and line transformer 117.

Hoist means 119 includes hoist 112 arranged to raise or lower carrying means 13. Hoist 112 is powered by first motor means 111, which may be any electrical motor arranged to raise or lower the hoist. Hoist means 119 also includes magnetic wheel 113 which is coupled to hoist 112. Sensor 116 monitors movement and status of hoist 112 through magnetic wheel 113 and provides signals indicative of this status to CPU 101. Trolley means 120 includes trolley 115 which is arranged to move hoist means 119 back and forth along transverse members 20 and 21. Trolley means 120 also includes second motor means 114 which powers trolley 115. Motor means 114 may be any electrical motor arranged to propel trolley 115 back and forth. In a preferred embodiment, first motor means 111 and second motor means 114 are DC motors. However, AC motors could perform the same function with appropriate motor speed control circuitry. Elements 101 through 106, 108 through 110, and 116 together constitute control means 118 for controlling first motor means 111 and second motor means 114, and also constitute safety means for sensing a malfunction and providing a response to the sensed malfunction, e.g. a controlled rate of descent.

CPU 101 is connected via control bus 121 and data bus 127 to PCCL 102. It should be noted that buses 121 and 127 each represent a plurality of lines which connect CPU 101 and PCCL 102. As described in detail infra, CPU 101, in conjunction with PCCL 102, functions to control the direction of rotation and on/off duty cycle of hoist motor 111 and trolley motor 114. The operator provides input signals to CPU 101 via wired control unit 105 or infra-red remote control unit 106. Hoist and trolley control signals, (up, down, forward, backward, etc.), are communicated from control unit 105 to CPU 101 via line 133, or from remote unit 106 via infra red signals to receiver 108 and then via line 134 to CPU 101. CPU 101 controls hoist and trolley motor speeds and monitors four voltage and current parameters: battery voltage, AC power status, hoist motor current, and trolley motor current. CPU 101 also signals annunciator 109 via line 122 to sound an audio or video alarm in the event of a loss of power or other malfunction. Sensor means 116, which may be a Hall sensor, detects motion of gear 113, and communicates this information to CPU 101 via line 135. For example, sensor means 116 may detect a malfunction such as a stall of hoist 112 during a lift operation. Finally, CPU 101 prevents hoist 112 from operating if battery 110 does not contain sufficient charge.

PCCL 102 communicates with PCMC 103 via lines 123 through 126, and with charging circuit 104 via line 132. Line 124 is used to sense battery Voltage; line 125 is used to communicate an indication of hoist motor current; and line 126 is used to communicate an indication of trolley motor current from PCMC 103 to PCCL 102. Line 132 is used to indicate battery charger AC input from charging circuit 104 to PCCL 102. PCCL 102 utilizes a serial A/D converter and multiplexes these signals for further processing and decision-making by CPU 101. Line 123 also transmits control signals to PCMC 103 to control motors 111 and 114 via lines 128 and 129, respectively. In particular, PCMC 103 switches motor lead polarities to control the direction of rotation of motors 111 and 114, and also controls motor on/off time via pulse width modulation (PWM). PCMC 103 also connects, via battery power line 130, the supply of battery power from battery 110 to motors 111 and 114.

Charging circuit 104 rectifies and triples AC power from line 131 and pre-regulates the DC voltage for PCCL 102 which is supplied via line 132. Circuit 104 also provides a trickle charge to battery 110. Battery 110 is used to power motors 111 and 114. Charging circuit 104 receives isolated low level (12 volts) AC power from remote transformer 117 via line 131. Thus, the entire system operates at relatively safe low level voltages.

FIGS. 5A, 5B, 5C, 5D and 5E illustrate a detailed schematic diagram of the electrical block diagram of FIG. 4.

Figure 5A:
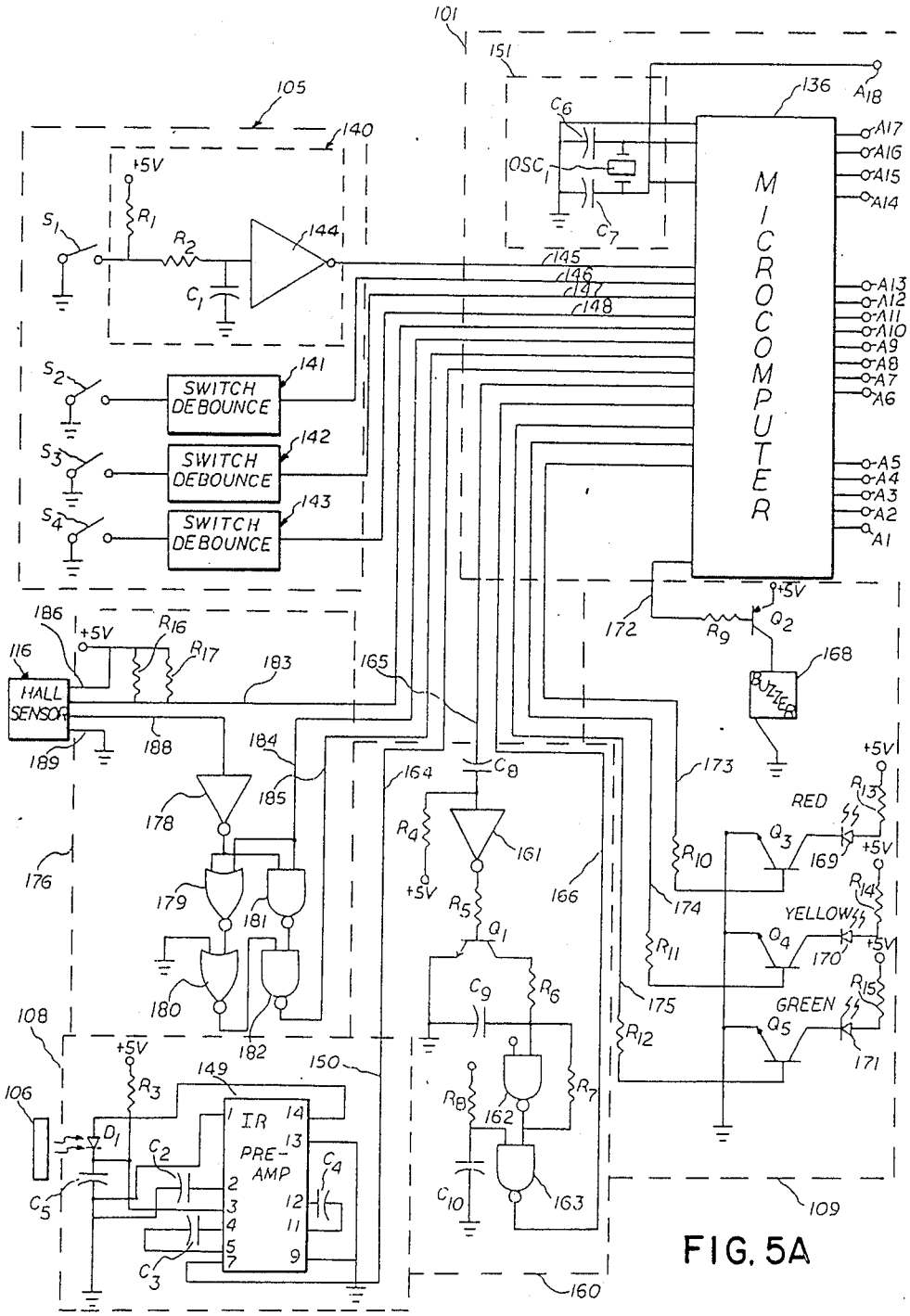
FIGS. 5A, 5B, 5C, 5D and 5E are detailed electrical schematic diagrams of the control and safety means of the invention.
Figure 5B:
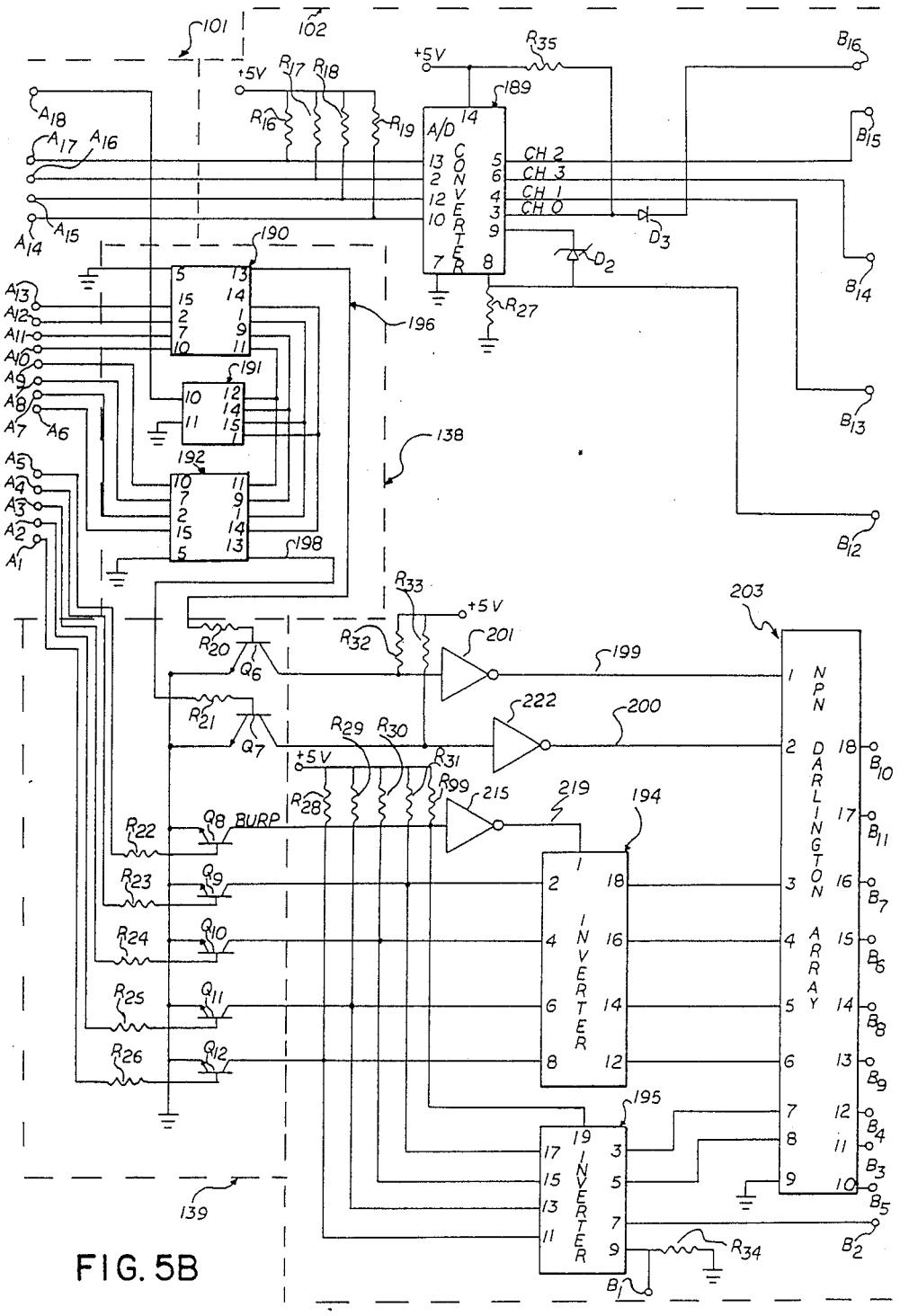

Referring to FIG. 5A and 5B, CPU 101 is shown as including microcomputer 136, oscillator circuit 151, pulse width modulation (PWM) control circuit 138, and high current buffer circuit 139. Microcomputer 136 is the heart of the control means and safety means of the invention. In a preferred embodiment, microcomputer 136 is an MCS®-51 family microcomputer, available from Intel Corporation, Santa Clara, Calif. Of course, any similar microcomputer may be substituted therefor. Microcomputer 136 receives input command signals from user controlled transmitter units and transmits appropriate signals to raise or lower hoist 112, or to move trolley 115. Microcomputer 136 also monitors system parameters such as AC line status, battery charge, hoist motor current, trolley motor current, and hoist motor speed, and is programmed to sense various system and user malfunctions or problems and to react accordingly When a problem is detected, microcomputer 136 reacts by transmitting appropriate command signals or warning signals as discussed infra.

Input signals are transmitted by the user to microcomputer 136 from wired control unit 105 or infra-red control unit 106. Wired control unit 105 is shown to comprise switches $S_1$, $S_2$, $S_3$, and $S_4$, and associated switch debounce circuits 140, 141, 142, and 143, respectively. Physically, switches $S_1$, $S_2$, $S_3$, and $S_4$ may be nothing more than momentary-contact push-button switches on a handheld unit controlled by a disabled person. Microcomputer 136 is programmed such that switches $S_1$ and $S_2$ control hoist 112 and switches $S_3$ and $S_4$ control trolley 115. Specifically, closing switch $S_1$ causes hoist 112 to raise carrying means 13; closing switch $S_2$ causes hoist 112 to lower carrying means 13; closing switch $S_3$ causes trolley 115 to travel is a forward direction; and closing switch $S_4$ causes trolley 115 to travel in a reverse direction. As is well known, a characteristic of a mechanical switch is that when the arm is thrown from one position to the other, this moving contact arm of the switch bounces or chatters several times before finally coming to rest in the position of contact. To prevent spurious or incorrect signals from reaching microcomputer 136, switch debounce circuits 140 through 143 function to filter the switch signals from $S_1$ through $S_4$, respectively, and present true command signals to the microcomputer. Debounce circuit 140 is a well-known Schmitt trigger circuit comprising inverter 144, resistors $R_1$ and $R_2$, and capacitor $C_1$. Circuits 141 through 143 are identical to circuit 140 and are thus shown only in block form. Any chatterless switch, such as a well known SR flip-flop, may perform the function of debounce circuits 140 through 143. As shown in FIG. 5A, command signals from switches $S_1$ through $S_4$ are transmitted through switch debounce circuits 140 through 143, respectively, and are communicated to microcomputer 136 via lines 145 through 148, respectively.

Alternatively, a disabled person may control the hoist and trolley from a remote control infra-red transmitter, thus obviating the need for a hard wire connection between the control unit and microcomputer 136. Remote control infra-red unit 106 also contains four switches similar to $S_1$ through $S_4$ for controlling hoist 112 and trolley 115. Unit 106 transmits infrared hoist and trolley command signals to receiver 108. Receiver 108 includes infra-red (IR) preamplifier 149 which amplifies the IR signals and communicates them to microcomputer 136 via line 150. IR preamplifier may be any infra-red preamplifier, such as TBA2800, available from National Semiconductor, Inc. Typical values for support circuitry $R_3$, $D_1$, and $C_2$ through $C_5$ are specified on National Semiconductor's Data Sheet for IR preamplifier TBA 2800.

Input signals which indicate the position of hoist 112 are received by microcomputer 136 from Hall sensor 116 via Hall sensing circuit 176. Hall sensor 116 is magnetically coupled to magnetic wheel 113 which is secured to hoist 112. Sensor 116 senses the incremental motion and position of hoist 112 and communicates quadrature position signals to Hall sensing circuit 176 via lines 183, 186, 188, and 189. Lines 183, 186, 188 and 189 are identical to lines 205, 206, 207 and 208, respectively, as shown on FIG. 3C. Sensing circuit 176, which includes inverter 178, NOR gates 179 and 180, NAND gates 181 and 182, and resistors $R_{16}$ and $R_{17}$, decodes the quadrature signals and communicates the position of hoist 112 to microcomputer 136 via lines 183, 184, and 185.

Oscillator circuit 151 provides the system clock and includes 11.0592 MHz crystal oscillator $OSC_1$ and capacitors $C_6$ and $C_7$. It is, of course, understood that different clock speeds may be used with different circuit components. Oscillator circuit 151 is connected to the XTAL1 and XTAL2 inputs of microcomputer 136.

Watchdog and reset circuit 160 functions to reset microcomputer 136 at power-up and also functions to sense an error or malfunction by the microprocessor should the processor not reset the watchdog. Circuit 160 is a standard watchdog and reset circuit and includes inverter 161, NAND gates 162 and 163, resistors $R_4$ through $R_8$, capacitors $C_8$ through $C_{10}$, and transistor $Q_1$. Watchdog and reset circuit 160 is connected to microcomputer 136 via lines 164, 165, and 166.

Various system malfunctions and user problems are indicated by annunciator circuit 109. Circuit 109 includes buzzer 168, red LED 169, yellow LED 170, and green LED 171. A buzzer drive circuit comprising $R_9$ and $Q_2$ drives buzzer 168 upon receiving an alarm signal from microcomputer 136 via line 172. Similarly, drive circuit $R_{10}$ and $Q_3$ drives red LED 169 when signaled by microcomputer 136 via line 173; drive circuit $R_{11}$ and $Q_4$ drives yellow LED 170 when signaled by microcomputer 136 via line 174; and drive circuit $R_{12}$ and $Q_5$ drives green LED 171 when signaled by microcomputer 136 via line 175.

Referring to FIG. 5B, pulse width modulation (PWM) control circuit 138 responds to command signals received via lines $A_6$ through $A_{13}$ from microcomputer 136 and provides output PWM control signals via lines 196 and 198. The PWM control signals control the on/off time, and hence the speed, of hoist motor 111 and trolley motor 114. Line 196 controls the hoist motor whereas line 198 controls the trolley motor. PWM circuit 138 includes 4-bit comparators 190 and 192 and 12-stage binary/ripple counter 191.

Figure 5C:
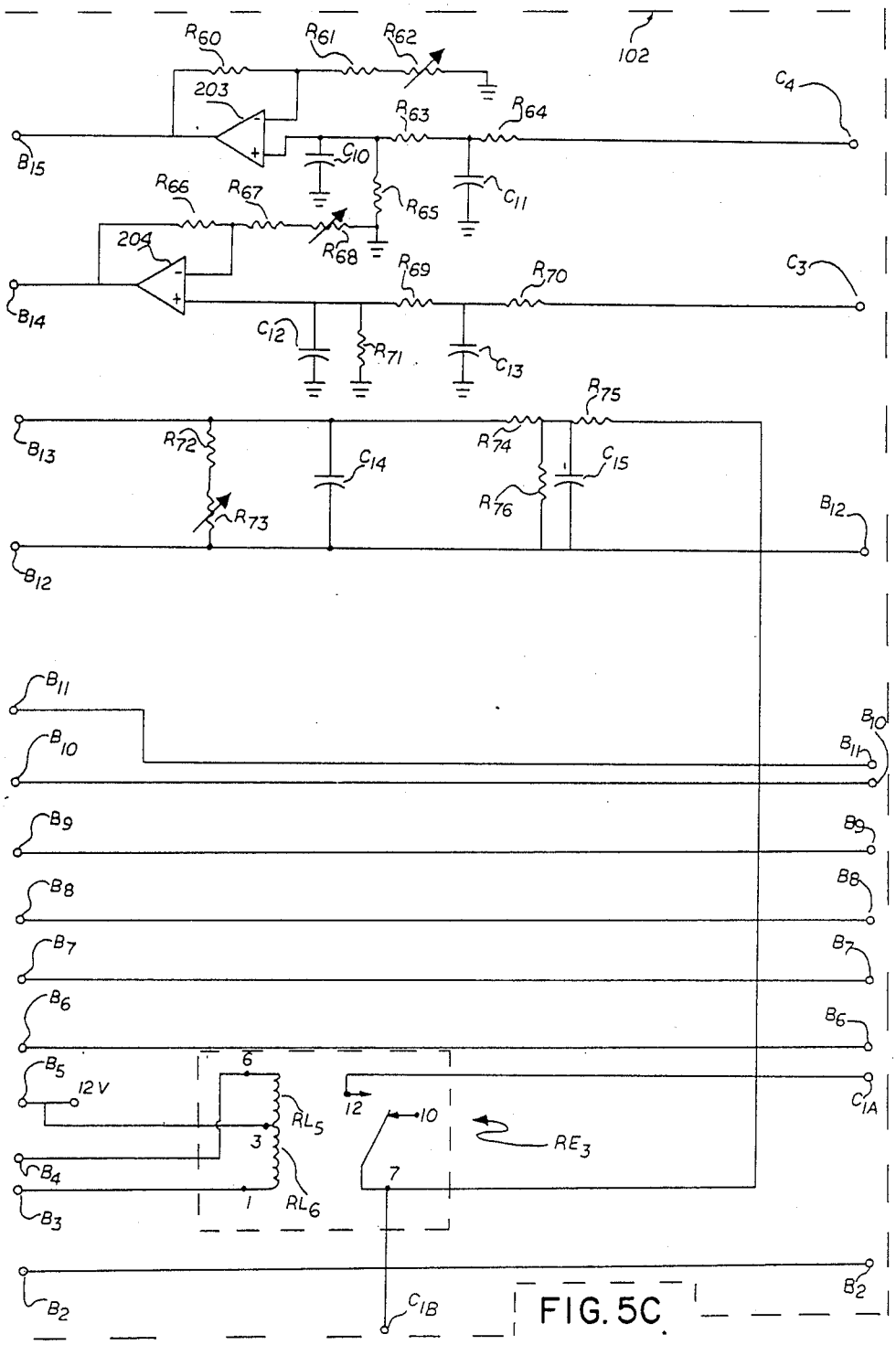
Figure 5D:
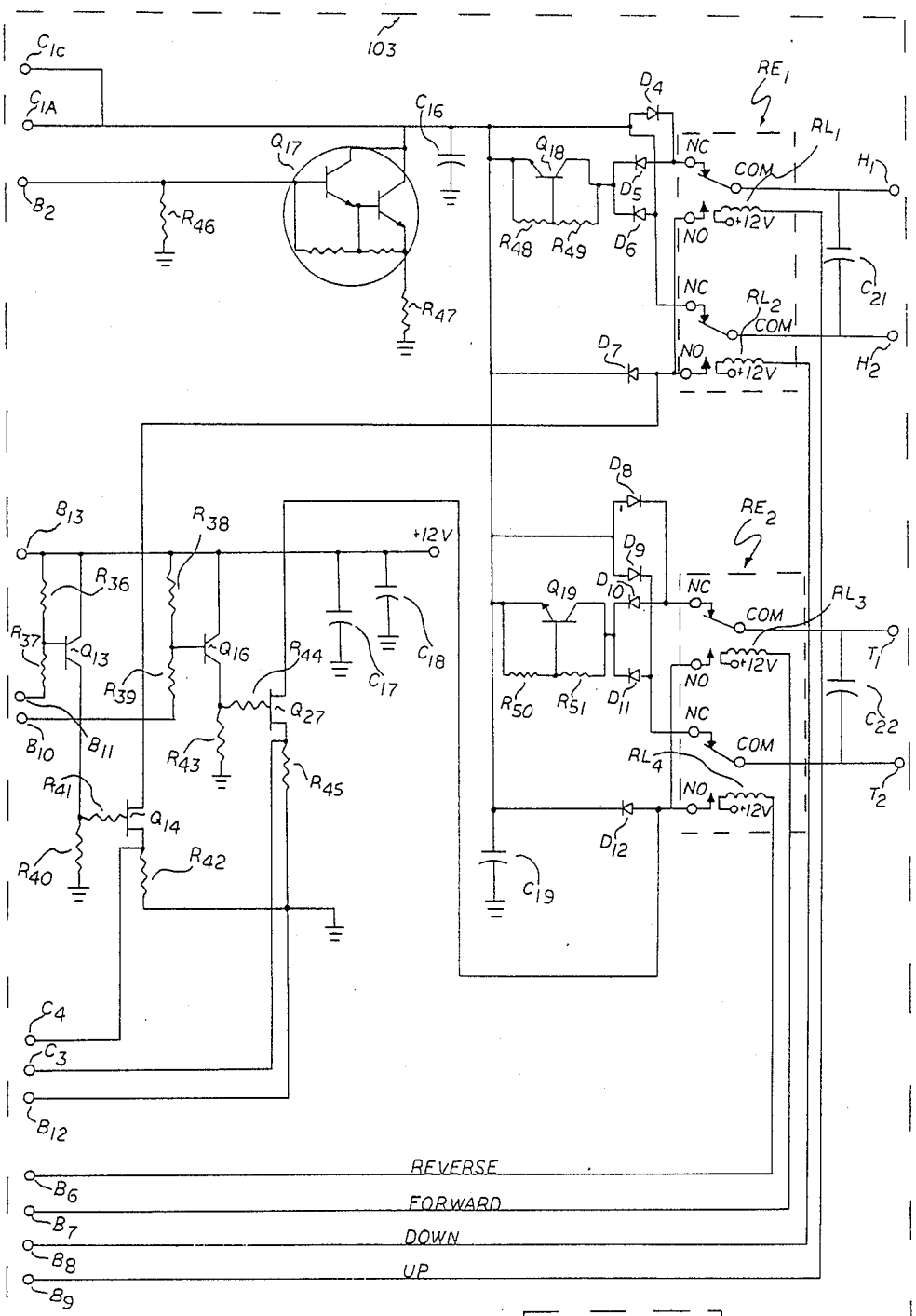
Figure 5E:
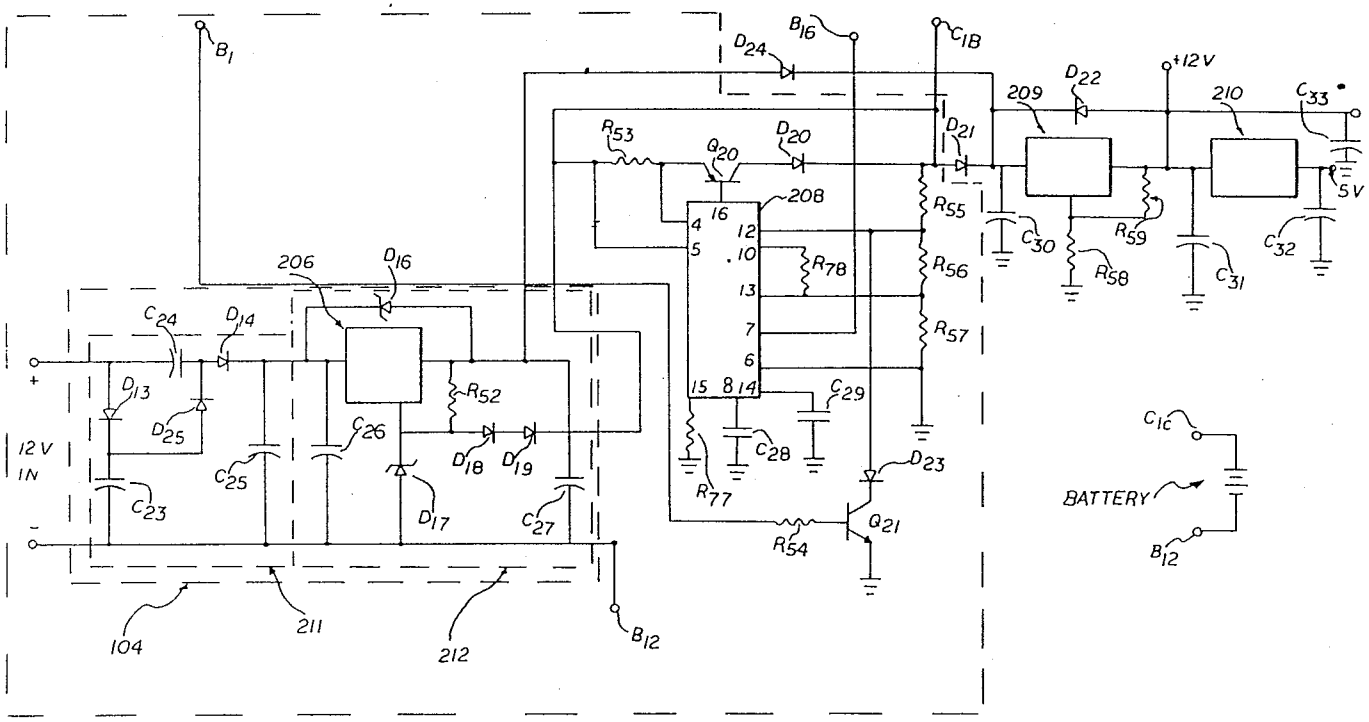

The remaining circuit elements shown in FIG. 5B, and the elements of FIGS. 5C and 5D, function to control hoist means 119 and trolley means 120, and to monitor various system parameters as discussed infra. FIG. 5E illustrates the battery, power supply, regulating and charging circuits of the invention.

CIRCUIT OPERATION

System Power Supply

Power for hoist motor 111 and trolley motor 114 is supplied solely by batteries as shown in FIG. 5E. In a preferred embodiment, battery power is supplied by two 6.5 amp-hour, 12 volt gelled electrolyte batteries, and is made available at lines $C_1$ and $B_{12}$ as shown in FIG. 5E. Power for motor control relays $RE_1$ and $RE_2$, (see FIG. 5D), and for battery latching relay $RE_3$ (see FIG. 5C) is supplied by +12 volt regulator 209. Regulator 209 also supplies power for +5 volt regulator 210. Regulator 209 receives power from charge module 205 or from the system battery, whichever has the higher voltage. Battery latching relay $RE_3$ functions to connect or disconnect the battery from the system and is under the control of microcomputer 136.

Referring to FIG. 5E, power for +12 volt regulator 209 (LM317T, or equivalent) is selected or steered by the diode network defined by $D_{21}$ and $D_{24}$. Capacitor $C_{30}$ (10 $\mu$F) serves as an input filter to ensure stability of regulator 209. Resistors $R_{59}$ and $R_{58}$ set the output of regulator 209 for +12 volts. The voltage across $R_{59}$ is 1.2 volts, which determines the current through $R_{58}$.

The output voltage is thus the 1.2 volts across $R_{59}$ and the voltage across $R_{58}$. Capacitor $C_{31}$ (10 μF) provides stability for both regulators 209 and 210. Power for +5 volt regulator 210 is supplied from +12 volt regulator 209. The output of regulator 210 is filtered by capacitor $C_{32}$ (10 μF). The +5 volt regulator supplies power for all logic functions in the circuit.

The system battery must be charged after each use of the hoist or after a long period of nonuse. Alternating current is supplied to the system by remote 12.6 volts AC line transformer 117 (see FIG. 4). The 12.6 VAC enters the system at the terminals marked "+12 V IN −" on FIG. 5E and provides power to charging module 104. Charging module 104 includes a voltage tripler section and a tracking pre-regulator/trickle charger section. Tripler section 211 includes capacitors $C_{23}$, $C_{24}$, and $C_{25}$, and diodes $D_{13}$, $D_{14}$, and $D_{25}$. Capacitor $C_{23}$ is first charged to approximately 17 volts by the incoming AC. Capacitor $C_{24}$ is then charged through diode $D_{25}$ to approximately 17 volts plus the peak AC voltage on the next half cycle on the AC input. Capacitor $C_{23}$ is, in fact, partially discharged by capacitor $C_{24}$. Capacitor $C_{23}$ is selected such that its capacitance is approximately twice that of capacitor $C_{24}$. On the next half cycle of the AC input, capacitor $C_{25}$ is charged through diode $D_{14}$ to the sum of the voltages across $C_{24}$ and the peak AC voltage. At no load, the output voltage available across $C_{25}$ is approximately three times the peak AC input voltage or 51 volts. The supply regulation is soft in that capacitor $C_{23}$ is used to supply the charge current for $C_{24}$, and $C_{24}$ is used to supply the charge current for $C_{25}$. Regulation is such that at low AC line voltage and full charge to the battery, the output from tripler section 211 is approximately 34 volts.

Since the 51 volt peak output of tripler section 211 exceeds the voltage specifications for voltage regulators 209 and 210, a pre-regulator section 212 comprising voltage regulator 206, diodes $D_{18}$ and $D_{19}$, zener diodes $D_{12}$ and $D_{16}$, capacitors $C_{26}$, $C_{27}$, and resistor $R_{52}$, function to pre-regulate the supply voltage to a value approximately 2.5 volts greater than the current battery voltage, and also supplies a regulated trickle current of approximately 0.005 amps to the battery.

Voltage regulator 206 is a 1.2 volt regulator, (LM317T or equivalent), that will set the voltage across resistor $R_{52}$ to 1.2 volts. Resistor $R_{52}$ is connected between the output pin and the adjust pin of voltage regulator 206. Resistor $R_{52}$ is also connected to the battery through diodes $D_{18}$ and $D_{19}$. The lower end of resistor $R_{52}$ will thus be at approximately the battery voltage plus two diode drops or approximately battery voltage plus 1.2 volts. Since regulator 206 sets the voltage across $R_{52}$ to be approximately 1.2 volts, the current through $R_{52}$ and the series diodes $D_{18}$ and $D_{19}$ will be equal to ($1.2/R_{52}$) or approximately 0.005 A, thus providing a trickle charge for the battery. Should the battery not be connected, zener diode $D_{12}$ sets the maximum voltage output of regulator 206 to 37.25 volts. Zener diode $D_{16}$ protects regulator 206 from overvoltage should the output become shorted, and from reverse bias should the input to the regulator become shorted.

The battery charge function is controlled by lead acid battery charger integrated circuit 208 and transistor $Q_{20}$. Circuit 208 is a special integrated circuit manufactured by Unitrode to monitor and control the charging of Gel cells, such as those used by this system. A Gel cell is a sealed lead-acid secondary cell and the charge characteristics are such that the charge voltage depends on the temperature and state of discharge and the desired charge current depends on the current percent of capacity. Since two 12 volt, 6.5 amp-hour batteries are connected in series for this unit and variations between batteries can cause differences in desired charge voltage and current, the charge circuit must compensate as much as possible and charge the batteries in a manner that will ensure reliable operation.

Circuit 208 is configured in the dual step mode. Assuming the batteries are in a partially discharged state, the charger will set the charge current to approximately 0.9 amps and maintain this charge current until the batteries reach a voltage of approximately 29 volts. Upon reaching 29 volts, the charger will cease charging and switch to a mode that will try to maintain the battery voltage at approximately 27 volts, supplying current only if the battery voltage drops to this level. Charge module 104 will supply approximately 0.005 amps continuously and will be the only supply of charge current when the batteries are in the float mode.

Circuit 208 sets the charge current by adjusting the base drive to $Q_{20}$. Circuit 208 senses the emitter current of $Q_{20}$ by monitoring the voltage across sense resistor $R_{53}$ and comparing this voltage to an internal reference voltage of 0.250 volts. During the charge phase, circuit 208 will attempt to maintain this voltage at 0.250 volts. Diode $D_{20}$ protects transistor $Q_{20}$ against reverse voltage. The battery voltage is sensed at the switch battery voltage line $C_{1B}$. This voltage is scaled down by a network comprised of resistors $R_{55}$, $R_{56}$, $R_{57}$, and $R_{78}$. The voltage at pin 13 of circuit 208 is used to set the state of the charger. If this voltage is above the internal reference voltage, pin 10 is switched to ground, causing the voltage divider network to change, and the mode to change to the no-current mode. If the battery now drops to the $V_f$ level sensed at pin 13, the charger will attempt to go into a voltage regulation mode and maintain the battery voltage at this level. Should the battery drop below approximately 25 volts, the regulator will again switch to the charge mode and supply 0.9 amps until the battery voltage reaches approximately 29 volts again and the cycle repeats.

Should the battery drop below approximately 20 volts, the regulator will switch off. This causes the charger to disconnect when it is desired to check the battery or if the battery shorts internally.

If no current is applied to circuit 208 by charging circuit 104, pin 7 of circuit 208 will be in the high impedance state. If voltage is present at the supply pin of circuit 208, pin 7 of circuit 208 will be in the low impedance state. Pin 7 of circuit 208 is an open collector output. Resistor $R_{77}$ and capacitors $C_{28}$ and $C_{29}$ set internal gains and frequency compensation for circuit 208.

Analog to Digital Conversion

Microcomputer 136 uses four channel, serial, analog to digital (A/D) converter 189 (FIG. 5B) to select and monitor four channels of information about system operation for use in decision making.

| | |
|---|---|
| Channel 0 (Ch0): | Indicates status of battery charger AC input.<br>A reading below half scale indicates AC is present.<br>A reading above half scale indicates no AC is present. |

-continued

| | |
|---|---|
| Channel 1 (Ch1): | Reads the voltage at the switched battery point. Full scale represents a voltage of 34 volts. |
| Channel 2 (Ch2): | Reads the current through the hoist motor. Full scale represents a current of 30 amps. |
| Channel 3 (Ch3): | Reads the current through the trolley motor. Full scale represents a current of 10 amps. |

The reference voltage for A/D converter 189 is supplied by reference zener diode $D_2$. The anode of $D_2$ is connected to the analog ground pin 8 of converter 189 and to the system master ground $B_{12}$. The cathode of reference zener diode $D_2$ is connected to pin 9 which is the A/D Ref input of converter 189, and receives bias from an internal resistor in A/D converter 189. A/D converter 189 doubles the reference voltage to set the full scale reading of the A/D converter, i.e., with a 1.2 volt reference, full scale is 2.4 volts on the selected input channel.

The analog ground of A/D converter 189 is connected to the digital ground and through resistor $R_{27}$ through master ground point $B_{12}$. The analog ground is used by the A/D input filter circuits and the scaling amplifiers, 203 and 204, for ground reference.

The inputs to A/D converter 189 are filtered and scaled as follows:

Channel 0:

Channel 0 input is pulled up to +5 volts by resistor $R_{35}$. Channel 0 input is also tied to pin 7 of 208 through diode $D_3$. If DC power is not available to 208, pin 7 of 208 will be in the high impedance state and therefore Channel 0 input will be +5 volts. If DC power is available to 208, pin 7 of 208 will be close to ground, approx 0.2 volts, $D_3$ will be forward biased, and Channel 0 will be approx 0.8 volts.

Channel 1:

Channel 1 input is from a resistor-capacitor network comprising resistors $R_{72}$ through $R_{76}$, and capacitors $C_{14}$ and $C_{15}$. Input to the network is from the switched battery line $C_{IB}$. The network is a two pole filter with a corner frequency of approximately 150 Hz. Resistor $R_{73}$ adjusts the scale factor of the network so that 34 volts on the input to $R_{75}$ gives 2.5 volts at the Channel 1 input pin 4 of A/D converter 189. The filter reduces the PWM noise produced by the motors when they are in operation.

Channel 2:

Channel 2 input is from hoist current sense resistor $R_{42}$ located in the source circuit of hoist power FET $Q_{14}$, (see FIG. 5D) and made available at line $c_4$. A resistor capacitor network comprised of resistors $R_{64}$, $R_{63}$, $R_{65}$, and capacitors $C_{10}$ and $C_{11}$ filters out the PWM noise and averages the input. The corner frequency of this two pole filter is approximately 200 Hz. Resistor $R_{65}$ serves to establish a ground for the scaling amplifier 203. Scaling amp 203 is configured as a non-inverter with a gain set by the resistor network $R_{60}$, $R_{61}$, and $R_{62}$. The gain is variable from approximately 3 to approximately 11. Since the current sense resistor is approximately 0.02 ohm, 30 amps of hoist current would result in approximately 0.6 volts, and a gain of approximately 4.167 set by adjusting $R_{62}$ would give 2.5 volts input to pin 5 of A/D converter 189 for 30 amps through the hoist motor.

Channel 3:

Channel 3 input is from trolley motor current sense resistor $R_{45}$ in series with the source of trolley power FET $Q_{27}$ and is made available at line $c_3$. In a manner analogous to Channel 2, the Channel 3 filter network is comprised of resistors $R_{69}$, $R_{70}$, $R_{71}$, and capacitors $C_{12}$ and $C_{13}$. The gain of scaling amplifier 204 is set by resistors $R_{66}$, $R_{67}$, and $R_{68}$. Current sense resistor $R_{45}$ for the trolley circuit is approximately 0.05 ohm. Therefore, a current of 12 amps through trolley motor 114 results in approximately 0.6 volts. Resistor $R_{68}$ adjusted such that 12 amps of trolley motor current gives 2.5 volts at input pin 6 of A/D converter 189.

A/D converter 189 is read by microcomputer 136 through control of pins 2, 12, 13, 10 of converter 189. Pin 2 of converter 189 is the Chip Select (CS) line, and connects to microcomputer 136 via line $A_{16}$. This pin resets and selects the A/D chip when taken from low to high and back low again. Pin 12 of converter 189 is the $A_{15}$ clock line and clocks in or out data to A/D converter 189 depending upon the number of cycles after the last lowering of the CS line. Pin 13 of converter 189 is the data input line $A_{17}$ and is used to set the mode and select the input channel to be monitored by converter 189 during the current selection by CS. Pin 10 of converter 189 is the data output line $A_{14}$ and outputs the completed conversion in serial fashion so that microcomputer 136 can read this conversion.

PCCL 102

The logic of PCCL 102 is such that at power-up or at watchdog timer time-out, all functions controlled by PCCL 102 are in the safe or non-operating state. At reset or at watchdog time-out, computer lines $A_1$ through $A_{17}$ will be set to a high impedance off state. Lines $A_1$ through $A_5$ connect to the bases of transistors $Q_{12}$ through $Q_8$, respectively, and, in the high impedance state, will not turn on the respective transistors. Since the collectors of these transistors are pulled up to +5 volts, the inputs to inverters 194 and 195 at pins 2, 4, 6, 8 and 17, 15, 13, 11, respectively, will all be +5 volts. The collector of transistor $Q_8$, connects to pin 19 of inverter 195 and to the input of inverter 215. A +5 volt signal at pin 19 of inverter 195 causes inverter 195 to be in the tri-state off condition, a safe no-action condition. The high input to inverter 215 causes a low output from inverter 215. The output of inverter 215 connects to pin 1 of inverter 194, causing the outputs of inverter 194 to be active. However, the inputs to inverter 194 are all high at reset and the outputs will all be low, which is a safe non-operative state for the system.

DEMULTIPLEXER

Computer lines $A_1$, $A_2$, $A_3$, and $A_4$ serve the dual function of controlling the motor relays $RE_1$ and $RE_2$, and controlling the status of the battery charge circuitry. Computer line $A_5$ controls the state of the demultiplex circuit comprised of inverters 194, 195 and 215, by routing commands from microcomputer 136 via lines $A_1$ through $A_4$ to the appropriate circuitry. Line $A_5$ controls the state of the demultiplex circuit by placing one quad inverter, either 194 or 195, in the active state, while placing the other inverter in the tri-state or inactive state. The demultiplex circuit functions in response to microcomputer command signals to place the system in either the motor control or battery control mode as follows:

Motor Control Mode

To place the system in the motor control mode, microcomputer 136 places a low on line $A_5$. This low is applied to the base of transistor $Q_8$, causing $Q_8$ to be in the cutoff state. The collector of $Q_8$ is tied to +5 volts through resistor $R_{99}$ so the input to inverter 215 and to pin 19 of quad inverter 195 are high. A high at pin 19 of quad inverter 195 causes the quad inverter outputs to be in the tri-state mode. This high impedance state allows output pins 3 and 5 of inverter 195 to be pulled low by pull-down resistors in Darlington array 203, and causes pin 7 to be pulled down by resistor $R_{46}$ and pin 9 to be pulled down by resistor $R_{34}$. All the outputs are connected to NPN type transistors whose emitters are tied to ground and these transistors will be biased to cutoff, a safe state for the system. The high input to inverter 215 causes its output to be low. The output of inverter 215 connects to pin 1 of quad inverter 194; a low at pin 1 causes the quad inverter outputs to be in the active state and therefore the outputs at pins 18, 16, 14, 12 reflect the inverse of their respective inputs at pins 17, 15, 13 and 11.

Battery Control Mode

To select the battery control mode, microcomputer 136 places a high signal on line $A_5$. The signals on pin 1 of quad inverter 194 and pin 19 will invert from their state described in the preceding paragraph, and inverter 215 will be in the active output mode and quad inverter 194 will be in the tri-state mode. Note that the output pins of quad inverter 194 connect to the bases of NPN Darlington transistors in array 203 and these transistor bases have pull-down resistors that will guarantee that if quad inverter 194 outputs are in the tri-state mode that these transistors will be in the cutoff bias state, a safe nonaction state for the system.

MOTOR CONTROL:

Microcomputer 136 controls the operation of the motors by controlling the logic levels on lines $A_1$ through $A_{13}$ and $A_{18}$. Signals communicated via lines $A_1$ through $A_5$ are buffered by open collector buffer circuit 139 of PCCL 102, whereas signals communicated via lines $A_6$ through $A_{13}$ and $A_{18}$ control PWM control circuit 138, the output of which is communicated to PCCL 102 via lines 196 and 198.

PCMC 103 accomplishes the direct control of power from the batteries to the motors at the direction of the +12 volt open collector logic signals from PCCL 102. The direction of motor rotation is accomplished by switching the direction of current flow through the motors. The direction of current flow through hoist motor 111 and trolley motor 114 is controlled by relays $RE_1$ and $RE_2$, respectively, (see FIG. 5D). The relays are SPDT with each motor connected between the common terminals, ($H_1$ and $H_2$ for hoist motor, $T_1$ and $T_2$ for trolley motor), and the positive terminal of the battery connected to the normally closed contacts either directly or through a power rectifier.

TROLLEY MOTOR CIRCUIT:

Relay $RE_2$ controls the power to trolley motor 114. Relay $RE_2$ comprises relay coils $RL_3$ and $RL_4$ and associated contacts, labeled NC, NO, COM on FIG. 5D. $RE_1$ and $RE_2$ each contain two single pole—double throw (SPDT) relays. The common contacts connect to the motor armature and, when $RL_3$ and $RL_4$ are in the de-energized state, the normally closed contacts connect the motor armature to the dynamic braking circuit composed of $Q_{19}$, $R_{50}$, and $R_{51}$ through full wave bridge network $D_8$, $D_9$, $D_{10}$, and $D_{11}$. If the motor turns in the forward direction at a rate high enough to produce at least two diode drops of voltage, the following will occur: a voltage will be developed by the armature causing current to enter terminal $T_1$, pass through the $RL_3$ common terminal COM to $RL_3$ normally closed terminal NC and then through diode $D_8$, being blocked by diode $D_{10}$. The current through $D_8$ passes through $R_{50}$ and $R_{51}$ and then through diode $D_{10}$ but is blocked by $D_{11}$, and then passes to the normally closed contacts NC of $RL_4$ to $RL_4$ common contact COM and returns to the motor armature. If current exists in the armature circuit a torque will be developed counteracting the force causing the rotation. The faster the rotation the higher the voltage and the greater the current. If the current in resistor string $R_{50}$ and $R_{51}$ causes a single diode drop in voltage (approximately 0.7 volts) across $R_{50}$, then the base of $Q_{19}$ will become forward biased and, since the emitter of $Q_{19}$ is connected to one end of the resistor string and the collector of $Q_{19}$ is connected to the other end, any attempt by the motor to increase the voltage drop across $R_{50}$ above one diode drop will cause $Q_{19}$ to remain forward biased, thereby reducing the effective resistance in the armature circuit and increasing the armature current and the resisting force or torque to the force causing motor rotation. The ratio of $R_{50}$ and $R_{51}$ determines the voltage at the base of $Q_{19}$ and therefore determines the rotation rate at which dynamic braking occurs. Note that if both $RL_4$ and $RL_5$ are energized that the normally open contacts will both be closed and, since the normally open contacts are connected together, the armature will be directly shorted out which maximizes dynamic braking. Under this condition, the dynamic braking does not occur at a controlled rotation rate set by $Q_{19}$ as described previously.

HOIST MOTOR CIRCUIT:

Relay $RE_1$ in the hoist circuit corresponds to $RE_2$ in the trolley circuit. $RE_1$ comprises relay coils $RL_1$ and $RL_2$ and their corresponding contacts labeled NC, NO and COM on FIG. 5D. The connection of the hoist motor circuit is identical to that of the trolley with the exception of the diode corresponding to $D_9$. This diode is absent as the current through this diode would be very high during lift operations and dynamic braking in the up direction need not be controlled. Dynamic braking in the up direction is effectively set at the one diode drop level. Dynamic braking in the down direction remains controlled. The rotation rate at which the braking becomes effective is controlled by the ratio of resistors $R_{48}$ and $R_{49}$, which provide for a fixed rate of descent of the hoist mechanism when no power is applied and the load is above the minimum necessary to cause armature motion. Thus, the maximum rate of descent is controlled over the hoist load range even with no power connected, creating a built-in safety feature. For illustration purposes, Table I below shows the relay states corresponding to the various hoist and trolley operation modes:

TABLE I

| POWER RELAY CHART: | | |
|---|---|---|
| MODE OF OPERATION (HOIST) | $RL_1$ | $RL_2$ |
| UP DIRECTION | ON | OFF |
| DOWN DIRECTION | OFF | ON |
| CONTROLLED DYNAMIC BRAKING | OFF | OFF |
| MAXIMUM DYNAMIC BRAKING | ON | ON |
| MODE OF OPERATION (TROLLEY) | $RL_3$ | $RL_4$ |
| FORWARD DIRECTION | ON | OFF |
| REVERSE DIRECTION | OFF | ON |
| CONTROLLED DYNAMIC BRAKING | OFF | OFF |

TABLE I-continued

| POWER RELAY CHART: | | |
|---|---|---|
| MAXIMUM DYNAMIC BRAKING | ON | ON |

To facilitate understanding, examples of circuit operation to effect hoist motor control (in the up direction) and trolley motor control (in the forward direction) follow:

HOIST MOTOR OPERATION (UP DIRECTION)

For the hoist motor to rotate in the up direction, relay coil $RL_1$ must be energized and $RL_2$ de-energized. $RL_1$ and $RL_2$ are driven by Darlington array 203 which in turn is controlled by quad inverter 194. To turn on $RL_1$ and turn off $RL_2$, inverter 194 must be the active quad inverter and the system is then said to be in the MC, motor control mode. The MC mode is selected by making $A_5$ low, causing $Q_8$ to be off and the collector of $Q_8$ to be pulled high, the input to inverter 215 high and its output to be low, causing quad inverter 194 to be active and quad inverter 195 to be in the tri-state mode. The computer activates $RL_1$ by applying a high on $A_1$. A high (+5 V) at $A_1$ couples through $R_{26}$ to the base of $Q_{12}$, causing $Q_{12}$ to be turned on. With $Q_{12}$ on, its collector is pulled to 0 volts. The collector of $Q_{12}$ is connected to pin 8 of quad inverter 194, and to pin 11 of inverter 195. Assuming inverter 194 is in the active state, output pin 12 will be at logic high (+5 volts) holding pin 6 of array 203 at +5 volts. Pin 6 of array 203 is the base of a Darlington transistor and will therefore be turned on. With the transistor on, relay coil $RL_1$ is energized. If $A_1$ is changed to the low state (0 volts), then the above-described levels reverse relay $RL_1$ is de-energized. In a similar manner, line $A_2$ is set to a low level to de-energize relay $RL_2$. The motor is now enabled for the up direction and is ready to receive PWM signals to turn the motor at the desired rate.

TROLLEY MOTOR OPERATION (FORWARD DIRECTION)

For the trolley motor to rotate in the forward direction, relay coil $RL_3$ must be energized and $RL_4$ de-energized. The common contact COM of RL3 must be connected to the normally open contact NO of $RL_3$ allowing the $T_1$ motor armature lead to be connected to the drain of FET $Q_{27}$ and flyback diode $D_{12}$. When $Q_{27}$ is turned on the current path is as follows: from ground up through power sense resistor $R_{45}$ through $Q_{27}$ into normally open contacts NC of $RL_3$ to terminal $T_1$ through the trolley motor armature, out terminal $T_2$ and back into common contact COM of $RL_4$ through normally closed contact of $RL_4$ through diode $d_9$ and into the positive terminal of the battery. When $Q_{27}$ is turned off, the energy stored in the inductance of the motor and the circuit wiring will induce current causing $T_1$ to go to a positive voltage with respect to $T_2$. Flyback diode $D_{12}$ will be turned on by this current and hold $T_1$ to one diode drop above $T_2$ thereby protecting power FET $Q_{27}$ from excessive voltage and maintaining the current in the motor so as to smooth out armature pulsations and therefore noise and vibration.

The speed of both the trolley and hoist motors is controlled by microcomputer 136 and associated circuitry using a scheme of pulse width modulation (PWM). For simplicity, the PWM scheme is described in detail here only for the trolley motor. If $Q_{27}$ is turned on and off the effective voltage across the motor armature may be controlled or modulated allowing for digital control of the motor armature current. For the trolley, this pulse width modulation (PWM) is controlled by the computer. The computer loads a four bit digital nibble on lines $A_{10}$, $A_{11}$, $A_{12}$, and $A_{13}$ into magnitude comparator 190. Four bit magnitude comparator 190 has one side connected to the computer lines previously mentioned and the four bits of counter 191. As counter 191 is continuously counting through a sequence, the output of comparator 190 will be a digital waveform with the ratio of high level to low level selectable by the computer. The output line of the comparator 196 connects through resistor $R_{20}$ to the base of transistor $Q_6$, turning $Q_6$ on and off. The collector of $Q_6$ connects to a pull-up resistor $R_{32}$ and inverter 201; the output of 201 will be the complement of the signal on line 196 and connects to the base of a Darlington transistor through pin 1 of array 203, turning this transistor on and off at the computer-set ratio. The corresponding output collector for pin 1 is pin 18, pin 18 connects to line $B_{10}$ and then through resistor $R_{39}$, connects to the base of transistor $Q_{16}$ and to pull-up resistor $R_{38}$, turning on and off $Q_{16}$. The collector of $Q_{16}$ connects to pull-down resistors $R_{43}$ and $R_{44}$; $R_{44}$ connects to the gate of transistor $Q_{27}$. Therefore, the computer controls the on/off ratio of $Q_{27}$ and therefore the current through the trolley motor by the digital word loaded onto comparator 190 lines $A_{10}$, $A_{11}$, $A_{12}$, and $A_{13}$. The hoist motor speed is controlled in the same manner.

BATTERY CONTROL:

The battery is checked by using inverters 194 and 195 as a multiplexer to direct appropriate control lines from microcomputer 136. The multiplexer is controlled by the "BURP" line which connects to the collector of transistor $Q_8$ as shown on FIG. 5B. If "BURP" is a logic low level then pin 19 of inverter 195 will be low and the output state of the four buffers controlled by pin 19 of inverter 195 will be active. Similarly, the low "BURP" signal presents a low signal to the input of inverting buffer 199. The output of inverter 199 will therefore be high, as will pin 1 of inverter 194. A logic high at pin 1 of inverter 194 forces all buffers controlled by pin 1 of inverter 194 to enter the tri-state condition. When "BURP" is low, the system is said to be in the Battery Control Mode.

If "BURP" is a logic high then exactly the opposite state outlined in the preceding paragraph exists, and the buffers controlled by pin 19 of inverter 195 would be in the tri-state mode and the buffers controlled by pin 1 of inverter 194 would be in the active mode. With "BURP" logic high, the system is said to be in the Motor Control Mode.

With "BURP" logic low and the system in the Battery Control Mode, a signal at the collector of transistor $Q_{12}$ will be presented to pin 11 of inverter 195 and is inverted by the active buffer of inverter 195 and the output signals which appears at pin 9 are communicated to the base of transistor $Q_{21}$ through resistor $R_{54}$. A low signal at the collector of $Q_{12}$ will force a high on the base of $Q_{21}$, turning $Q_{21}$ on and pulling the collector of $Q_{21}$ to ground. The collector of $Q_{21}$ is connected to the battery charger control IC 208 at pin 12 through diode $D_{23}$. Pin 12 of charger IC 208 connects to the switched battery line through the junction of $R_{55}$ and $R_{56}$, where $R_{55}$ and $R_{56}$ form part of a voltage divider string $R_{55}$, $R_{56}$, $R_{57}$, and $R_{78}$. With $Q_{21}$ turned on, the voltage at pin 12 of charger IC 208 will be within 0.2 volts of ground, and the charge control chip 208 will be turned off and the only charge current to the battery will be from the trickle current that biases the charge pre-voltage regulator, (approximately 0.005 A if the AC to the unit is connected).

If the collector of $Q_{12}$ is logic high, then $Q_{21}$ will conversely be off and charge control chip 208 will be in normal operational mode.

The collector of transistor $Q_{11}$ connects to pin 13 of inverter 195 and with pin 6 of inverter 194. Inverter 194 is inactive in the Battery Control Mode and therefore pin 14 of inverter 194 is in the tri-state mode. Inverter 195 is active, however, and therefore pin 13 logic level is inverted and output on pin 7 of inverter 195. Pin 7 of inverter 195 connects to the base of Darlington transistor $Q_{17}$. Therefore, when the system is in the Battery Control Mode, a logic high at the collector of $Q_{11}$ presents a logic low on the base of $Q_{17}$ and therefore $Q_{17}$ is in the non-conduction state. A logic low at the "BURP" line will cause a logic high at pin 7 of inverter 195 and a logic high (approximately 5.0 volts) at the base of transistor $Q_{17}$. Since $Q_{17}$ is a Darlington transistor with a high beta gain, the emitter of $Q_{17}$ will be at approximately two diode drops from the base or at approximately 3.8 volts. The current necessary to maintain 3.8 volts across the 3.9 ohm resistor $R_{47}$ resistor in the emitter circuit of $Q_{17}$ comes from the battery line and so a load of 3.8 V/3.9 Ω or approximately 1 ampere is drawn from the battery circuit. This load current is maintained for a wide range of battery voltage and serves as a no load to be used to calculate the health or charge state of the batteries.

The collector of transistor $Q_{10}$ is connected to pin 4 of inverter 194 and pin 15 of inverter 195. In the Battery Control Mode, inverter 194 is inactive and the normal output for pin 4 is in the tri-state mode. Inverter 195 is active in the Battery Control Mode, however, and therefore the output for pin 15, which appears at pin 5, is the inverse logic level of pin 15. Pin 5 of inverter 195 connects to pin 8 of array 213. As stated previously, chip 213 is an array of 8 Darlington transistors, all having their emitters tied to pin 9 and all having transient suppression diodes with the cathodes of these diodes tied to the collectors of each transistor and the anodes tied to pin 10. Pin 8 of array 213 is the base of one of the Darlingtons and the corresponding collector is pin 11. Pin 11 connects to pin 3 of relay $RE_3$ via line $B_3$.

The collector of transistor $Q_9$ connects to pin 2 of inverter 194 and pin 17 of inverter 195. If the Battery Control Mode is active, inverter 194 is in the inactive mode and inverter 195 is in the active mode. Pin 3 is the corresponding output pin for input pin 17 and connects to pin 7 of array 213. Pin 7 of array 213 is the base of a transistor whose collector is pin 12. Pin 12 of array 213 connects to pin 6 of relay $RE_3$.

$RE_3$ is a magnetic latching relay. This relay maintains the last contact state with no power applied. Power is applied to only one of the two coils $RL_5$ or $RL_6$ at any given time. If power is applied to the opposite coil from the current contact state, the relay will switch contact positions and remain in that new position when power is removed. The two coils are connected in series such that pin 3 is a center tap and with pin 3 tied to +12 volts, grounding either pin 1 or pin 6 will switch the state of the relay. A ground applied to pin 1 will force a closure between pins 10 and 7. A ground on pin 6 will force a closure between pins 10 and 7. Since pin 12 is connected to the battery line via line $C_1$ and pin 7 of $RE_3$ is connected to the switched battery line, a ground on pin 1 of $RE_3$ will connect the battery to the switched battery line and a ground on pin 6 of $RE_3$ will disconnect the battery from the switched battery line.

Table II below illustrates circuit operation for both the motor control mode and battery control mode:

TABLE II

| Motor Control Mode | [Line $A_5$ at logic high (+5 volts); inverter 194 in active state; inverter 195 in tri-state] | | |
|---|---|---|---|
| Input signal | Line | Relay | Relay State |
| 0 | $A_1$ | UP | De-energized |
| 0 | $A_2$ | DOWN | De-energized |
| 0 | $A_3$ | FORWARD | De-energized |
| 0 | $A_4$ | REVERSE | De-energized |
| 1 | $A_1$ | UP | Energized |
| 1 | $A_2$ | DOWN | Energized |
| 1 | $A_3$ | FORWARD | Energized |
| 1 | $A_4$ | REVERSE | Energized |
| Battery Control Mode | [Line $A_5$ at logic low (0 volts)] inverter 194 tri-state inverter 195 active-state | | |
| Input Signal | Line | Result | |
| 0 | $A_1$ | Charging circuit 208 OFF | |
| 1 | $A_1$ | Charging circuit 208 ON | |
| 0 | $A_2$ | Burp load - 1 Amp load ON | |
| 1 | $A_2$ | Burp load - no load on | |
| 0 | $A_3$, $A_4$ | Relay coil $RL_6$ de-energized, battery connected | |
| 1 | $A_3$, $A_4$ | Relay coils $RL_4$, $RL_5$ energized, battery disconnected | |

SAFETY MEANS

The present invention includes safety means which continuously monitors the system for a variety of malfunctions, and provides appropriate action in response to the malfunction. This is accomplished by using microcomputer 136 as a "watchdog" of all inputs and system operations. The microcomputer is programmed to infer problems and take action accordingly. In particular, microcomputer 136 is programmed to detect two types of malfunctions or problems: operator failure and product failure.

Operator Failure

Operator failure may consist merely of the operator dropping the control unit or it may mean the user has lost consciousness. Microcomputer 136 senses this problem by recognizing that an "up" signal was transmitted but a subsequent "down" signal was not received within a reasonable time. In this case, the hoist is programmed to return to its starting position (usually a bed or a wheelchair) and lower the person at a very slow, controlled rate of descent. The system is also programmed to concurrently sound an alarm to alert others of the difficulty.

Product Failure

Product failure includes the possibility of AC power failure which would tend to leave the patient in a helpless and possibly dangerous position. In the event of AC power failure or other hardware problems, the system is programmed to switch to battery back-up to power the electronics, to return to the "home" or starting position, and to "back drive" the patient to a resting position using the inherent characteristics of a gear drive/motor combination to provide a governed or controlled rate of descent. The present invention thereby avoids the problem of prior art devices which, upon power failure, would mechanically lock the hoist in a position that would suspend the patient on a hook and require that the patient be lifted from the hook to return to a resting place.

Described above are illustrative examples to demonstrate the safety mechanisms of the present invention. These examples should not be interpreted as the only malfunctions the system can detect and avoid. Microcomputer 136 is programmed to detect a wide spectrum of operator and product failures.

It will thus be seen that the objects set forth above, among those made apparent from the preceding description, are efficiently obtained. Since certain changes may be made in carrying out the above invention and in the constructions set forth without departing from the scope of the invention, it is intended that all matter contained in the above description or shown in the accompanying drawings be interpreted as illustrative and not in a limiting sense. It is also be be understood that the following claims are intended to cover all of the generic and specific features of the invention herein described, and all statements of the scope of the invention, which, as a matter of language, might be said to fall therebetween.

What is claimed is:

1. Apparatus for transporting a disabled person in a carrying means, comprising:

a pair of vertically adjustable end support members having upper and lower ends wherein the upper ends of said vertical end support members are adapted to provide friction engagement with a ceiling;

a pair of transverse support members extending between said end support members;

hoist means to raise or lower the carrying means;

trolley means to move said hoist means back and forth along said transverse support members;

first motor means to power said hoist means;

second motor means to power said trolley means; and control means to control said first and second motor means.

2. Apparatus as recited in claim 1 wherein said transverse support members are horizontal.

3. Apparatus as recited in claim 1 further comprising safety means to sense a malfunction in said hoist means, said trolley means, said first motor means, said second motor means or said control means and to provide a response to said sensed malfunction.

4. A device as recited in claim 3 wherein said response comprises activating an annunciator to indicate said malfunction.

5. A device as recited in claim 3 wherein said response comprises providing a controlled rate of descent of said hoist.

6. Apparatus as recited in claim 1 further comprising safety means to sense when said disabled person fails to issue an expected command to said hoist means within a predetermined period and to activate an annunciator to indicate said failure.

7. Apparatus as recited in claim 1 further comprising safety means to sense when said disabled person fails to issue an expected command to said hoist means within a predetermined period and to provide a controlled rate of descent of said disabled person in response to said failure.

8. Apparatus as recited in claim 1 further comprising safety means to sense a failure of electric power supplied to said first motor means, said second motor means or said control means and to activate a backup power supply in response to said failure.

9. Apparatus for transporting a disabled person in a carrying means, comprising:

support means adapted to engage both a ceiling and a floor;

hoist means secured to said support means for raising and lowering the carrying means; and safety means to sense a malfunction in said hoist means, and to provide a controlled rate of descent of said hoist in response to said malfunction.

10. A device as recited in claim 9 wherein said safety means activates an annunciator to indicate said malfunction.

11. Apparatus as recited in claim 9 wherein said support means is adjustable in height to provide engagement with ceilings of different heights.

12. Apparatus for supporting a hoist for disabled persons, comprising:

a pair of vertically adjustable end support members wherein the upper ends of said vertical end support members are adapted to provide friction engagement with a ceiling; and a pair of transverse support members extending between and fixedly secured proximate the upper ends of said vertical end support members;

wherein said transverse support members are arranged to support a heist for disabled persons.

13. A safety device for an electric hoist for disabled persons, comprising:

means for sensing a malfunction in said hoist; and, means for providing a controlled rate of descent of said hoist in response to said sensed malfunction.

14. A device as recited in claim 13 wherein said malfunction is a failure or electric power supplied to said hoist and said controlled rate of descent is accomplished without electric power by backdriving gears within said hoist.

15. A device as recited in claim 14 wherein said sensing means comprises an electronic circuit to sense said failure of electric power supplied to said hoist.

16. A method for providing safety for a disabled person being carried by a hoist, comprising:

sensing a malfunction in said hoist; and providing a controlled rate of descent of said hoist in response to said malfunction.

17. A method for supporting a hoist and trolley for a disabled person, comprising supporting said hoist and trolley by means of a support structure in contact with a floor and a ceiling, said support structure having a dual track in contact with a ceiling wherein each track has a web which supports one or more trolley wheels and wherein the distance from the ceiling to the bottom of the body of said supported hoist and trolley is independent of the thickness of said web.

18. Apparatus for transporting a disabled person in a carrying means, comprising:

support means adapted to engage both a ceiling and a floor;

hoist means secured to said support means for raising and lowering the carrying means; and safety means to sense when said disabled person fails to issue an expected command to said hoist means within a predetermined period and to provide a controlled rate of descent of said disabled person in response to said failure.

19. Apparatus as recited in claim 18 wherein said support means is adjustable in height to provide engagement with ceilings of different heights.

20. Apparatus as recited in claim 18 wherein said safety means activates an annunciator to indicate said failure.

21. A safety device for an electric hoist for a disabled person, comprising:

means for sensing when said disabled person fails to issue an expected command to said hoist within a predetermined period; and, means for providing a controlled rate of descent of said hoist in response to said failure.

22. A device as recited in claim 21 wherein said controlled rate of descent is accomplished without electric power by backdriving gears within said hoist.

23. A method for providing safety for a disabled person being carried by a hoist, comprising:

sensing when said disabled person fails to issue an expected command to said hoist within a predetermined period; and providing a controlled rate of descent of said hoist in response to said failure.

* * * * *